US008840731B2

(12) United States Patent
Fischer et al.

(10) Patent No.: US 8,840,731 B2
(45) Date of Patent: Sep. 23, 2014

(54) PREPARATIONS, THEIR PRODUCTION AND USE

(71) Applicants: Sonja Fischer, Plankstadt (DE); Juergen Tropsch, Roemerberg (DE); Heike Weber, Mannheim (DE); Roland Ettl, Altlussheim (DE)

(72) Inventors: Sonja Fischer, Plankstadt (DE); Juergen Tropsch, Roemerberg (DE); Heike Weber, Mannheim (DE); Roland Ettl, Altlussheim (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/707,836

(22) Filed: Dec. 7, 2012

(65) Prior Publication Data

US 2013/0150277 A1 Jun. 13, 2013

Related U.S. Application Data

(60) Provisional application No. 61/568,691, filed on Dec. 9, 2011.

(51) Int. Cl.

| | |
|---|---|
| ***C11D 1/72*** | (2006.01) |
| ***B08B 3/04*** | (2006.01) |
| ***C11D 1/825*** | (2006.01) |
| ***C11D 3/39*** | (2006.01) |
| ***C11D 3/37*** | (2006.01) |
| ***C11D 3/386*** | (2006.01) |
| ***C11D 3/06*** | (2006.01) |

(52) U.S. Cl.

CPC ..... *C11D 3/3788* (2013.01); *C11D 1/825* (2013.01); *C11D 3/39* (2013.01); *C11D 3/3769* (2013.01); *C11D 1/721* (2013.01); *C11D 3/3757* (2013.01); *C11D 3/3776* (2013.01); *C11D 3/386* (2013.01); *C11D 3/06* (2013.01)

USPC ..... 134/25.2; 134/25.3; 134/39; 134/42; 510/220; 510/230; 510/421; 510/434; 510/475; 510/499; 510/505

(58) Field of Classification Search

USPC ..... 510/220, 230, 421, 434, 475, 499, 505; 134/25.2, 25.3, 39, 42

See application file for complete search history.

(56) References Cited

U.S. PATENT DOCUMENTS

| | | | | |
|---|---|---|---|---|
| 4,904,408 | A | 2/1990 | Kud et al. | |
| 2003/0186833 | A1* | 10/2003 | Huff et al. | 510/475 |
| 2006/0228317 | A1 | 10/2006 | Chrisstoffels et al. | |
| 2008/0293828 | A1* | 11/2008 | Bouillo et al. | 514/772.3 |
| 2009/0298735 | A1* | 12/2009 | Boeckh et al. | 510/220 |

FOREIGN PATENT DOCUMENTS

| | | | |
|---|---|---|---|
| DE | 198 19 187 | A1 | 11/1999 |
| DE | 100 42 815 | A1 | 3/2002 |
| DE | 102 33 834 | A1 | 2/2004 |
| DE | 103 11 616 | A1 | 9/2004 |
| EP | 0 285 038 | A2 | 10/1988 |
| EP | 0 851 023 | A2 | 7/1998 |
| WO | WO 2007/051743 | A2 | 5/2007 |
| WO | WO 2008/132131 | A1 | 11/2008 |

OTHER PUBLICATIONS

European Search Report issued May 8, 2012 in European Patent Application No. 11192855.2 (with English Translation of Category of Cited Documents).

International Search Report Issued Mar. 1, 2013 in PCT/EP2012/074393 (with English translation of Categories of Cited Documents).

* cited by examiner

*Primary Examiner* — Brian P Mruk

(74) *Attorney, Agent, or Firm* — Oblon, Spivak, McClelland, Maier & Neustadt, L.L.P.

(57) ABSTRACT

A composition for machine dishwashing that includes a one copolymer obtainable by copolymerization of N-vinylamide, vinyl acetate, polyether, and alkoxylate.

10 Claims, No Drawings

PREPARATIONS, THEIR PRODUCTION AND USE

This application claims the benefit of U.S. 61/568,691 filed Dec. 9, 2011.

The present invention relates to the use of preparations comprising (a1) at least one copolymer obtainable by copolymerization of (a1.1) at least one N-vinylamide, (a1.2) vinyl acetate, (a1.3) at least one polyether, (a1.4) optionally at least one further comonomer, (a2) at least one alkoxylate of the general formula (I)

$$R^1—(OCH_2CHR^2)_mOR^3 \quad (I)$$

where the variables are defined as follows:

$R^1$ is $C_8$-$C_{24}$-alkyl, linear or branched, $R^2$ is $C_1$-$C_{10}$-alkyl, in each case identical or different, linear or branched, or hydrogen, $R^3$ is hydrogen or $C_1$-$C_4$-alkyl, linear or branched, m is a number in the range from 1 to 100, in formulations for automatic dishwashing.

The present invention further relates to the use of specific copolymers.

Demanding requirements are placed on formulations for machine dishwashing. Besides the actual residue-free cleaning, it is desirable to obtain dishes, metal objects and glasses which shine faultlessly. Up until about 2001, in many cases, a detergent, a rinse aid and a so-called regenerating salt were therefore metered separately into the dishwasher, the regenerating salt having the task of binding calcium ions and magnesium ions, and the rinse aid having the task of ensuring water runs off the whole area of the ware and preventing the formation of lime marks and water marks.

"3 in 1" dishwashing detergents introduced since then combine the function of detergent, rinse aid and regenerating salt in one product. As a result, there is no need for the consumer to replenish rinse aid and salt in the dishwasher. The incorporation of further functions (e.g. protection against glass corrosion and protection against the tarnishing of silver) led to the development of x in 1 (where e.g. x=6 or 9) or "all in one" products.

WO 2008/132131 discloses the use of a combination of at least one alcohol alkoxylate, at least one short-chain alcohol ethoxylate, at least one sulfonate-group-containing polymer and/or at least one hydrophilically modified polycarboxylate and optionally a polycarboxylate, together with generally customary further constituents, for improving the clear-rinse performance in phosphate-containing and in phosphate-free machine dishwashing detergents.

DE 102 33 834 A discloses, as nonionic surfactants in compositions for machine dishwashing, alkoxylated, preferably ethoxylated, primary alcohols having 8 to 18 carbon atoms and on average 1 to 12 mol of ethylene oxide (EO) per mole of alcohol. Preference is given to alcohol ethoxylates of alcohols of native origin having 12 to 18 carbon atoms, such as coconut, palm, tallow fatty or coleyl alcohol, having on average 2 to 8 mol of EO per mole of alcohol.

Many "X in 1" or "all-in-one" dishwashing detergents still do not achieve the good clear-rinse result which can be achieved with the use of separate rinse aid, namely streak-free and droplet-free run-off of the water from the dishes such that they are obtained in a shiny form and without dried-on water drops (spotting). It has also been found that when washing especially in somewhat harder water, i.e. at 10°German hardness and above, the filming can also be improved. In this connection, filming is understood as meaning the formation of an undesired deposit over an area. Accordingly, the values for filming are better the more uniform and smaller the deposits arising on the surfaces of the objects to be washed.

It was therefore the object to provide formulations which can be used in "X in 1" or "all in one" dishwashing detergents such that the rinse aid or rinse aids can be dosed for example via a tablet in the main wash cycle, but a good effect is only observed in the clear-rinse cycle.

Accordingly, the use of preparations defined at the start in formulations for machine dishwashing have been found, also called preparations used according to the invention for short.

Preparations used according to the invention comprise (a1) at least one copolymer, also called copolymer (a1) for short. Copolymer (a1) is obtainable by copolymerization of (a1.1) at least one N-vinylamide, for example N-vinylformamide or N-vinylacetamide, preferably at least one N-vinyllactam, for example N-vinylpyrrolidone and N-vinylcaprolactam, (a1.2) vinyl acetate, (a1.3) at least one polyether, (a1.4) optionally at least one further comonomer, for example (meth)acrylic acid, (meth)acrylonitrile and $C_1$-$C_4$-alkyl (meth)acrylates.

Examples of suitable polyethers (a1.3) are polybutylene glycols, obtainable by the polymerization of 2,3-dimethyloxirane or 2-ethyloxirane. Preferred polyethers (a1.3) are selected from polyethylene glycol, polypropylene glycol and polytetrahydrofuran, and from mixed polymers of ethylene oxide and propylene oxide and/or 2,3-dimethyloxirane or 2-ethyloxirane. The aforementioned mixed polymers of ethylene oxide and propylene oxide and/or 2,3-dimethyloxirane or 2-ethyloxirane can be random copolymers or block copolymers, for example those of ethylene oxide and propylene oxide may be of the AB type or of the ABA type.

Polyether (a1.3) can be unilaterally or bilaterally etherified with $C_1$-$C_{20}$-alkanol or an alkylating agent, in each case identical or different, preferably with $C_1$-$C_{18}$-alkanol, for example with methanol, ethanol, n-butanol, isopropanol, n-propanol, isobutanol, n-pentanol, n-hexanol, n-octanol, n-nonanol, n-decanol, n-dodecyl alcohol, n-tridecanol, n-hexadecanol or n-octadecanol.

In another embodiment of the present invention, polyether (a1.3) is a diol.

In one embodiment of the present invention, polyether (a1.3) has an average molecular weight $M_w$ in the range from 1000 to 100 000 g/mol, preferably 1500 to 35 000 g/mol, particularly preferably 10 000 g/mol. The average molecular weights $M_w$ are determined starting from the OH number measured in accordance with DIN 53240, or by gel permeation chromatography (GPC).

In a preferred embodiment of the present invention, copolymer (a1) is a graft copolymer in which at least one polyether (a1.3) serves as graft base onto which N-vinylamide (a1.1), vinyl acetate (a1.2) and optionally at least one further comonomer (a1.4) are grafted, for example by free-radical copolymerization.

In one embodiment of the present invention, in those copolymers (a1) which are graft copolymers, N-vinylamide (a1.1), vinyl acetate (a1.2) and optionally at least one further comonomer (a1.4) are grafted on randomly in the side chains. In another embodiment of the present invention, branches of such copolymers (a1) which are graft copolymers comprise in each case only polymerized-in N-vinylamide (a1.1) or only vinyl acetate (a1.2) or optionally only further comonomer (a1.4).

Examples of suitable further comonomers (a1.4) are (meth)acrylic acid, (meth)acrylonitrile and $C_1$-$C_4$-alkyl (meth)acrylates, preferably acrylic acid, methyl acrylate, ethyl acrylate and n-butyl acrylate.

In one embodiment of the present invention, copolymer (a1) has an average molecular weight $M_w$ in the range from 90 000 to 140 000 g/mol, determined by GPC.

In one embodiment of the present invention, copolymer (a1) has a K value in accordance with Fikentscher in the range from 10 to 60, preferably 15 to 40, measured in a 1% by weight ethanolic solution at room temperature.

In one embodiment of the present invention, copolymer (a1) comprises, in polymerized-in form:

in total in the range from 30 to 80% by weight, preferably 40 to 70% by weight, particularly preferably 50 to 60% by weight, of N-vinylamide (a1.1), in total in the range from 10 to 50% by weight, preferably 15 to 35% by weight, particularly preferably 25 to 35% by weight, of vinyl acetate (a1.2), in total in the range from 10 to 50% by weight, preferably up to 30% by weight, particularly preferably up to 25% by weight and very particularly preferably up to 20% by weight, of polyether (a1.3), in total in the range from zero to 10% by weight of comonomer(s) (a1.4), in each case based on the mass of the total copolymer (a1).

Preparations used according to the invention furthermore comprise (a2) at least one alkoxylate of the general formula (I), $$R^1—(OCH_2CHR^2)_mOR^3 \quad (I)$$

also called alkoxylate (a2) for short, in which the variables are:

$R^1$ is $C_8$-$C_{24}$-alkyl, branched or preferably linear, for example n-octyl, n-decyl, n-dodecyl, n-tetradecyl, n-hexadecyl, n-octadecyl, n-eicosyl, $R^2$ is $C_1$-$C_{10}$-alkyl, in each case identical or different, linear or branched, methyl, ethyl, n-propyl, isopropyl, n-butyl, isobutyl, sec-butyl, tert-butyl, n-pentyl, isoamyl, isopentyl; n-hexyl, isohexyl, sec.-hexyl, n-octyl, n-decyl, isodecyl, particularly preferably methyl
or preferably hydrogen, $R^3$ is hydrogen or $C_1$-$C_4$-alkyl, branched or preferably linear, for example methyl, ethyl, n-propyl, isopropyl, n-butyl, isobutyl, sec-butyl, tert-butyl, particularly preferably methyl or n-butyl, m is a number in the range from 1 to 100. The number m refers to an average value and can be an integer, but does not have to be an integer.

Alkoxylates of the formula (I) can, if m is chosen to be greater than 1 and at least two $R^2$ are different from one another, be random copolymers or block copolymers; they are preferably block copolymers. In embodiments in which the groups $R^2$ are different and m is chosen to be greater than 3, preferably greater than 5, the different alkoxide units can be arranged in alkoxylate (a2) in random distribution or blockwise, preferably blockwise.

Preferred alkoxylates (a2) are alkoxylated, preferably ethoxylated, primary alkanols having 8 to 18 carbon atoms and on average 1 to 12 mol of ethylene oxide (EO) per mole of alkanol. Particular preference is given to alkoxylates of alcohols of native origin having 12 to 18 carbon atoms, such as coconut, palm, tallow fatty or oleyl alcohol, ethoxylated with on average 2 to 8 mol of EO per mole of $C_8$-$C_{18}$-alkanol. By way of example, mention may be made specifically of $C_{12}$-$C_{14}$-alkanols, ethoxylated with on average 3 or 4 mol of EO per mole of alkanol, $C_9$-$C_{11}$-alkanols, ethoxylated with on average 7 mol of EO per mole of alkanol, $C_{13}$-$C_{15}$-alkohols, ethoxylated with on average 3, 5, 7 or 8 mol of EO per mole of alkanol, and also $C_{12}$-$C_{18}$-alcohols, ethoxylated with on average 5 mol of EO per mole of alkanol.

Furthermore, mention may specifically be made of mixtures of $C_{13}$- to $C_{15}$-oxo alcohols, alkoxylated with 9 mol of ethylene oxide and 2 mol of butylene oxide per mole, iso-$C_{10}$-alkohols, alkoxylated with 10 mol of ethylene oxide and on average 1.5 mol of 1,2-pentene oxide, $C_{10}$- to $C_{12}$-fatty alcohols, alkoxylated with 9 mol of ethylene oxide and 5 mol of propylene oxide, $C_{13}$- to $C_{15}$-oxo alcohols, alkoxylated with on average 4.46 mol of ethylene oxide+0.86 mol of butylene oxide, terminally capped in a single position with a methyl group, 2-propylheptanol, alkoxylated with 4.5 mol of ethylene oxide and on average 0.9 mol of propylene oxide and mixtures of at least two of the aforementioned alkoxides (a2).

Of alkoxylates of the formula (I), preference is given to ethoxylates of the formula (II)

$$R^1—(OCH_2CH_2)_x—OR^3 \quad (II)$$

where $R^1$ is a linear $C_{16}$-$C_{18}$-alkyl radical, $R^3$ is a linear or branched $C_1$-$C_6$-alkyl or preferably hydrogen, x is in the range from 8 to 10, preferably 8, 9 or 10.

Particularly preferred ethoxylates of the formula (II) are those based on tallow fatty alcohols ($C_{16}$-$C_{18}$-alcohols) having on average 9 mol of ethylene oxide per mole of tallow fatty alcohol.

Preferred linear $C_{16}$-$C_{15}$-alkanols are n-hexadecanol and n-octadecanol. These can be obtained by hydrogenation of natural tallow fat. Also of suitability, however, is the linear $C_{17}$-alkanol.

Mixtures of linear $C_{16}$- and $C_{18}$-alkanols of natural origin are also known as tallow fatty alcohol. Tallow fatty alcohols have a small proportion of unsaturated fractions, in particular fractions of mono- or polyunsaturated $C_{16}$- and $C_{18}$-alcohols. However, based on the amount of alcohol, these are generally at most 5% by weight, preferably 0.1 to 2% by weight. Within the context of the present invention, tallow fatty alcohols should preferably be included under $C_{16}$-$C_{18}$-alkanols on account of the only slight contamination with unsaturated alkanols.

In one embodiment of the present invention, preparations used according to the invention comprise in the range from 1 to 60% by weight of copolymer (a1) and 40 to 99% by weight of alkoxylate (a2), preferably 1 to 50% by weight of copolymer (a1) and 50 to 99% by weight of alkoxylate (a2).

In one embodiment of the present invention, copolymer (a1) and alkoxylate (a2) are present in preparations used according to the invention as a solid solution. In this connection, the term "solid solution" is intended to refer to a state in which copolymer (a1) is in microdisperse distribution, or ideally in molecularly disperse distribution, in a solid matrix of alkoxylate (a2), as can be shown, for example, by microscopy.

In one embodiment of the present invention, preparations used according to the invention (a) are in the form of pourable and flowable water-soluble powders.

In one embodiment of the present invention, preparations used according to the invention (a) are in the form of powders with an average particle diameter in the range from 100 to 1500 μm. In another embodiment of the present invention, preparations used according to the invention (a) are in the form of granules.

In another embodiment of the present invention, preparations used according to the invention (a) are in the form of compact mixtures or of a layer, for example as spheres or hemispheres for dishwasher tablets or in the form of coatings of whole dishwasher tablets or as coatings of parts of dishwasher tablets, for example individual surfaces or segments of surfaces of dishwasher tablets.

Using preparations used according to the invention as or for producing formulations for dishwashing gives dishes which are superbly cleaned and in particular have few lime marks. Furthermore, when using formulations described above, washed dishes exhibit very good filming properties.

The present invention further provides the use of preparations used according to the invention in formulations for machine dishwashing, also called use according to the invention for short. The present invention further provides a machine dishwashing method using at least one formulation used according to the invention. The present invention further provides formulations for machine dishwashing comprising at least one preparation used according to the invention, for example in the range from 0.1 to 20% by weight, based on the formulation used according to the invention.

In one embodiment of the present invention, formulations used according to the invention comprise:

(a) in total in the range from 0.1 to 20% by weight of at least one preparation used according to the invention, preferably 0.5 to 15% by weight, particularly preferably 1 to 10% by weight,
(b) in total in the range from 0 to 10% by weight of nonionic surfactant which is different from copolymer (a1) and from alkoxylate (a2), also called surfactant (b) for short,
(c) in total in the range from 0 to 20% by weight of one or more polycarboxylates, also called polycarboxylate (c) for short,
(d) in total in the range from 0 to 50% by weight of complex formers which are different from inorganic phosphates, also called complex formers (d) for short,
(e) in total in the range from 0 to 70% by weight of one or more inorganic phosphates, also called phosphate (e) for short,
(f) in total in the range from 0 to 60% by weight of further builders and cobuilders which are in each case different from complex formers (d), also called builders (f) or cobuilders (f) for short,
(g) in total in the range from 0 to 30% by weight of bleaches, also called bleaches (g) for short, and optionally bleach activators or bleach catalysts,
(h) in total in the range from 0 to 8% by weight of enzyme(s),
(i) in total in the range from 0 to 50% by weight of one or more further additives, and optionally water.

Here, data in % by weight are based on total solids content of formulation used according to the invention.

In one embodiment of the present invention, formulations used according to the invention have a pH in the range from 5 to 14, preferably 8 to 13.

In one embodiment of the present invention, formulations used according to the invention can have a water content in the range from 0.1 to 10% by weight, based on the total solids content of formulation used according to the invention.

Surfactant (b) can also be referred to below as component (b). Polycarboxylate (c) can also be referred to below as component (c). Complex former (d) can also be referred to below as component (d), etc. Preferably, formulations used according to the invention comprise at least one substance selected from component (b) to component (i), where component (i) is different from water.

In one embodiment of the present invention, additives (i) are selected from anionic or zwitterionic surfactants, alkali carriers, corrosion inhibitors, antifoams, dyes, fragrances, fillers, organic solvents, tableting auxiliaries, disintegrants, thickeners and solubility promoters.

Components (b) to (i) are described in more detail below by way of example.

Besides the nonionic surfactants of component (a) present in preparations (a) used according to the invention, formulations used according to the invention can comprise up to 10% by weight of surfactant(s) (b), for example weakly or low-foaming nonionic surfactants.

Preferably, formulations used according to the invention comprise in total in the range from 0.1 to 10% by weight, preferably from 0.25 to 5% by weight, of surfactant (b).

In one embodiment of the present invention, surfactant (b) is selected from di- and multiblock copolymers, composed of $C_1$-$C_{20}$-alkanol, ethylene oxide and propylene oxide.

In another embodiment of the present invention, surfactant (b) is selected from reaction products of sorbitan esters with ethylene oxide and/or propylene oxide. Further suitable surfactants (b) are selected from ethoxylated or propoxylated sorbitan esters. Amine oxides or alkyl glycosides are likewise suitable. An overview of suitable further nonionic surfactants can be found in EP-A 0 851 023 and in DE-A 198 19 187.

In one embodiment of the present invention, formulations used according to the invention comprise a mixture of two or more different surfactants (b).

In one embodiment of the present invention, preparation used according to the invention comprises at least one polycarboxylate (c), for example alkali metal salts of (meth) acrylic acid homopolymers or (meth)acrylic acid copolymers. Preferably, formulations used according to the invention comprise in total in the range from 0.1 to 20% by weight of polycaboxylate(s) (c).

Suitable comonomers for (meth)acrylic acid copolymers are monoethylenically unsaturated dicarboxylic acids such as maleic acid, fumaric acid, maleic anhydride, itaconic acid and citraconic acid. A suitable acrylic acid polymer is in particular polyacrylic acid, which preferably has an average molecular weight $M_w$ in the range from 2000 to 40 000 g/mol, preferably 2000 to 10 000 g/mol, in particular 3000 to 8000 g/mol. Also of suitability are copolymeric polycarboxylates (c), in particular those of acrylic acid with methacrylic acid and of acrylic acid or methacrylic acid with maleic acid and/or fumaric acid.

It is also possible to use copolymers of at least one monomer from the group consisting of monoethylenically unsaturated $C_3$-$C_{10}$-mono- or dicarboxylic acids or anhydrides thereof, such as maleic acid, maleic anhydride, acrylic acid, methacrylic acid, fumaric acid, itaconic acid and citraconic acid, with at least one hydrophilically or hydrophobically modified monomer, as listed below.

Suitable hydrophobic monomers are, for example, isobutene, diisobutene, butene, pentene, hexene and styrene, olefins having 10 or more carbon atoms or mixtures thereof, such as, for example, 1-decene, 1-dodecene, 1-tetradecene, 1-hexadecene, 1-octadecene, 1-eicosene, 1-docosene, 1-tetracosene and 1-hexacosene, $C_{22}$-α-olefin, a mixture of $C_{20}$-$C_{24}$-α-olefines and polyisobutene having on average 12 to 100 carbon atoms.

Suitable hydrophilic monomers are monomers with sulfonate or phosphonate groups, and also nonionic monomers with hydroxy function or alkylene oxide groups. By way of example, mention may be made of: allyl alcohol, isoprenol, methoxypolyethylene glycol (meth)acrylate, methoxypolypropylene glycol (meth)acrylate, methoxypolybutylene glycol (meth)acrylate, methoxypoly(propylene oxide-co-ethylene oxide) (meth)acrylate, ethoxypolyethylene glycol (meth)acrylate, ethoxypolypropylene glycol (meth)acrylate, ethoxypolybutylene glycol (meth)acrylate and ethoxypoly (propylene oxide-co-ethylene oxide) (meth)acrylate. The polyalkylene glycols here comprise 3 to 50, in particular 5 to 40 and especially 10 to 30 alkylene oxide units.

Particularly preferred sulfonic-acid-group-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethyl-methacrylamide, and salts of said acids, such as sodium, potassium or ammonium salts thereof.

Particularly preferred phosphonate-group-containing monomers are vinylphosphonic acid and its salts.

In one embodiment of the present invention, formulations used according to the invention comprise in the region of up to 50% by weight of complex former (d), for example at least 0.1% by weight, preferably 1 to 45% by weight and particularly preferably 1 to 40% by weight.

Preferred complex formers (d) are selected from aminocarboxylates and polyaminocarboxylates and salts thereof, in particular alkali metal salts, and derivatives thereof, such as, for example, methyl esters.

Within the context of the present invention, aminocarboxylates are understood as meaning nitrilotriacetic acid and those organic compounds which have a tertiary group which has one or two $CH_2$—COOH groups which—as mentioned above—can be partially or completely neutralized. Within the context of the present invention, polyaminocarboxylates are understood as meaning those organic compounds which have at least two tertiary amino groups which, independently of one another, each have one or two $CH_2$—COOH groups which—as mentioned above—can be partially or completely neutralized.

In another embodiment of the present invention, aminocarboxylates are selected from those organic compounds which have a secondary amino group which has one or two CH(COOH)$CH_2$—COOH group(s) which—as mentioned above—can be partially or completely neutralized. In another embodiment of the present invention, polyaminocarboxylates are selected from those organic compounds which have at least two secondary amino groups which each have a CH(COOH)$CH_2$—COOH group which—as mentioned above—can be partially or completely neutralized.

Particularly preferred aminocarboxylates and polyaminocarboxylates are selected from nitrilotriacetic acid (NTA), ethylenediaminetetraacetic acid (EDTA), diethylenetriaminepentaacetic acid, hydroxyethylethylenediaminetriacetic acid and methylglycinediacetic acid (MGDA), glutamic acid-diacetic acid, iminodisuccinic acid, hydroxyiminodisuccinic acid, ethylenediamine-disuccinic acid, aspartic acid-diacetic acid, and salts thereof, for example alkali metal salts thereof, in particular potassium and sodium salts thereof. Particularly preferred complex formers (d) are methylglycinediacetic acid and salts thereof.

As component (e), formulation used according to the invention can comprise in the region of up to 70% by weight of phosphate (e), for example in the range from 5 to 60% by weight, particularly preferably in the range from 20 to 55% by weight.

Examples of phosphates (e) are in particular alkali metal phosphates and polymeric alkali metal phosphates, which can be selected in the form of their alkaline, neutral or acidic sodium or potassium salts. Examples of such phosphates (e) are trisodium phosphate, tetrasodium diphosphate, disodium dihydrogendiphosphate, pentasodium tripolyphosphate, so-called sodium hexametaphosphate, oligomeric trisodium phosphate with a degree of oligomerization of 5 to 1000, preferably 5 to 50, and the corresponding potassium salts, or mixtures of sodium hexametaphosphate and the corresponding potassium salts, or mixtures of the sodium and potassium salts. Preferred phosphates (e) are alkali metal phosphates, in particular pentasodium or pentapotassium triphosphate (sodium or potassium tripolyphosphate), also sodium metaphosphate.

In a preferred embodiment of the present invention, formulation used according to the invention comprises no phosphate (e); formulations having less than 100 ppm by weight of phosphate (e), based on the solids content of the particular formulation used according to the invention, are deemed to be phosphate-free within the context of the present invention.

As component (f), formulation used according to the invention can comprise in the region of up to 60% by weight of builder (f) or cobuilder (f), for example in the range from 0.1 to 60% by weight. Within the context of the present invention, builder (f) and cobuilder (f) are to be understood as meaning water-soluble or water-insoluble substances which are different from inorganic phosphate and from complex former (d) and whose main aim consists in the binding of calcium ions and magnesium ions.

Builders (f) can be selected from low molecular weight carboxylic acids and salts thereof, such as citric acid and its alkali metal salts, in particular anhydrous trisodium citrate or trisodium citrate dihydrate. Further suitable builders (f) are also succinic acid and its alkali metal salts, fatty acid sulfonates, α-hydroxypropionic acid, alkali metal malonates, fatty acid sulfonates, $C_1$-$C_{20}$-alkyl or $C_2$-$C_{20}$-alkenyl disuccinates, tartaric acid diacetate, tartaric acid monoacetate, oxidized starch, oxydisuccinate, gluconic acids, oxadiacetates, carboxymethyloxysuccinates, tartrate monosuccinate, tartrate disuccinate, tartrate monoacetate, tartrate diacetate and α-hydroxypropionic acid.

Further examples of suitable builders (f) are silicates, in particular sodiumdisilicate and sodium metasilicate, zeolites, sheet silicates, in particular those of the formula α-$Na_2Si_2O_5$, β-$Na_2Si_2O_5$, and δ-$Na_2Si_2O_5$.

Examples of cobuilders (f) are phosphonates, for example hydroxyalkanephosphonates and aminoalkanephosphonates. Among the hydroxyalkanephosphonates, 1-hydroxyethane-1,1-diphosphonate (HEDP) is preferred as cobuilder (f). It is preferably used as the sodium salt, the disodium salt giving a neutral reaction and the tetrasodium salt giving an alkaline reaction (pH 9). Suitable aminoalkanephosphonates are preferably ethylenediaminetetramethylene-phosphonate (EDTMP), diethylenetriaminepentamethylenephosphonate (DTPMP), and higher homologs thereof. They are preferably used in the form of the neutrally reacting sodium salts, e.g. as hexasodium salt of EDTMP or as hepta- and octasodium salt of DTPMP.

Furthermore, carbonates and hydrogencarbonates are used, of which preference is given to the alkali metal salts, in particular sodium salts, for example sodium carbonate and sodium hydrogencarbonate.

In one embodiment of the present invention, formulations used according to the invention comprise in the region of up to 30% by weight of bleach (g) and optionally one or more bleach activators or bleach catalysts.

In one embodiment of the present invention, formulations used according to the invention comprise one or more oxygen bleaches or one or more chlorine-containing bleaches. Examples of suitable oxygen bleaches are sodium perborate, anhydrous or for example as monohydrate or as tetrahydrate or so-called dihydrate, sodium percarbonate, anhydrous or for example as monohydrate, hydrogen peroxide, persulfates, organic peracids such as peroxylauric acid, peroxystearic acid, peroxy-α-naphthoic acid, 1,12-diperoxydodecanedioic acid, perbenzoic acid, 1,9-diperoxyazelaic acid, diperoxyisophthalic acid, in each case as free acid or as alkali metal salt, in particular as sodium salt, also sulfonylperoxy acids and cationic peroxy acids.

Formulations used according to the invention can comprise, for example, in the range from 0.5 to 15% by weight of oxygen bleaches.

Suitable chlorine-containing bleaches are, for example, 1,3-dichloro-5,5-dimethylhydantoin, N-chlorosulfamide, chloramine T, chloramine B, sodium hypochlorite, calcium hypochlorite, magnesium hypochlorite, potassium hypochlorite, potassium dichloroisocyanurate and sodium dichloroisocyanurate.

Formulations used according to the invention can comprise, for example, in the range from 3 to 10% by weight of chlorine-containing bleach.

Formulations used according to the invention can comprise one or more bleach catalysts. Bleach catalysts can be selected from bleach-boosting transition metal salts or transition metal complexes such as, for example, manganese-, iron-, cobalt-, ruthenium- or molybdenum-salen complexes or manganese-, iron-, cobalt-, ruthenium- or molybdenum-carbonyl complexes. Manganese, iron, cobalt, ruthenium, molybdenum, titanium, vanadium and copper complexes with nitrogen-containing tripod ligands, and also cobalt-, iron-, copper- and ruthenium-amine complexes can also be used as bleach catalysts.

Formulations used according to the invention can comprise one or more bleach activators, for example N-methylmorpholinium-acetonitrile salts ("MMA salts"), trimethylammonium acetonitrile salts, N-acylimides such as, for example, N-nonanoylsuccinimide, 1,5-diacetyl-2,2-dioxohexa-hydro-1,3,5-triazine ("DADHT") or nitrile quats, i.e. trimethylammonium acetonitrile salt(s).

In one embodiment of the present invention, formulation used according to the invention comprises in the range from 0.1 to 10% by weight of bleach activator, preferably from 1 to 9% by weight, particularly preferably from 1.5 to 8% by weight, based on the total formulation used according to the invention.

Formulations used according to the invention can comprise, for example, in total up to 8% by weight of enzyme (h), preferably 0.1 to 3% by weight, in each case based on the total solids content of the formulation used according to the invention. Examples of enzymes (h) are lipases, hydrolases, amylases, proteases, cellulases, esterases, pectinases, lactases and peroxidases.

In one embodiment of the present invention, formulations used according to the invention can comprise in total in the range from 0.1 to 50% by weight of one or more additives (i). Examples of additives (i) are anionic or zwitterionic surfactants, alkali carriers, corrosion inhibiters, antifoams, dyes, fragrances, fillers, organic solvents, tableting auxiliaries, disintegrants, thickeners and solubility promoters.

Disintegrants are also called tablet disintegrants. Examples are crosslinked polyvinyl-pyrrolidones.

An example of a tableting auxiliary is polyethylene glycol, for example with a molecular weight $M_w$ of at least 1500 g/mol. An example of a tableting auxiliary is polyethylene glycol, for example with a molecular weight $M_w$ of more than 1500 g/mol up to at most 8000 g/mol.

Examples of anionic surfactants are $C_8$-$C_{20}$-alkyl sulfates, $C_8$-$C_{20}$-alkylsulfonates and $C_8$-$C_{20}$-alkyl ether sulfates having one to 6 ethylene oxide units per molecule.

Examples of zwitterionic surfactants are derivatives of quaternary aliphatic ammonium salts or phosphonium salts or of tertiary sulfonium salts in which the aliphatic groups may be unbranched or branched and in which one of the aliphatic substituents has a $C_6$-$C_{20}$-alkylene radical, preferably a $C_8$-$C_{18}$-alkylene radical, which carries an anionic group, for example a carboxyl group, a sulfate group, a phosphate group or a phosphonic acid group.

Specific examples of zwitterionic surfactants are betaines, for example cocamidopropylbetaine.

Formulations used according to the invention can comprise one or more alkali carriers. Alkali carriers ensure, for example, a pH of at least 9 if an alkaline pH is desired. Of suitability are, for example, alkali metal carbonates, alkali metal hydrogencarbonates, alkali metal hydroxides and alkali metal metasilicates. A preferred alkali metal in each case is potassium, particularly preferably sodium.

Formulations used according to the invention can comprise one or more corrosion inhibitors. In the present case, these are to be understood as meaning those compounds which inhibit the corrosion of metal. Examples of suitable corrosion inhibitors are triazoles, in particular benzotriazoles, bisbenzotriazoles, aminotriazoles, alkylaminotriazoles, also phenol derivatives such as, for example, hydroquinone, pyrocatechol, hydroxyhydroquinone, gallic acid, pholoroglucine or pyrogallol.

In one embodiment of the present invention, formulations used according to the invention comprise in total in the range from 0.1 to 1.5% by weight of corrosion inhibitor.

In one embodiment of the present invention, formulations used according to the invention comprise glass corrosion inhibitors. Glass corrosion can be evident from clouding, iridescence, streaking and lines on glass surfaces. Preferred glass corrosion inhibitors are selected from the group of magnesium, zinc and bismuth salts and complex compounds of zinc, magnesium or bismuth.

Formulations used according to the invention can comprise one or more antifoams, selected for example from silicone oils and paraffin oils.

In one embodiment of the present invention, formulations used according to the invention comprise in total in the range from 0.05 to 0.5% by weight of antifoam.

In one embodiment of the present invention, formulations used according to the invention can comprise one or more acids, for example methanesulfonic acid or its salts.

In one embodiment of the present invention, formulations used according to the invention can have one or more dyes. An example of a suitable dye is patent blue.

In one embodiment of the present invention, formulations used according to the invention can comprise one or more fragrances, for example a perfume.

In one embodiment of the present invention, formulations used according to the invention can comprise one or more preservatives, for example 2-methyl-2H-isothiazol-3-one (Kathon (CG).

A suitable filler is, for example, sodium sulfate.

Examples of suitable organic solvents are ethanol, isopropanol and propylene glycol.

Cleaning formulations used according to the invention can be liquid, a gel or in solid form, single-phase or multiphase, in the form of tablets or in the form of other dosage units.

If formulations used according to the invention are used for washing dishes, then dishes are obtained which are cleaned superbly and in particular have very few lime marks. Furthermore, dishes washed using formulations used according to the invention exhibit very good filming properties.

The present invention further provides the use of formulations used according to the invention for machine dishwashing. The present invention further provides a method for machine dishwashing using at least one formulation described above In this connection, the expression "dishes" in connection with dishwashing should be understood as meaning not only porcelain crockery and plastic dishes, but also cutlery, for example silver cutlery or plastic cutlery, and also pots, pans, kitchen utensils such as, for example, lemon presses or garlic presses or measuring jugs, and also glasses and glass vessels for cooking.

Preferably, the machine dishwashing is washing using a dishwasher (automatic dishwashing).

In one embodiment of the present invention, water with a hardness in the range from 1 to 30°German hardness, preferably 2 to 25°German hardness, is used, German hardness being understood in particular as meaning the calcium hardness.

As a result of the washing method according to the invention, dishes are obtained which are cleaned superbly and in particular have very few lime marks. Furthermore, dishes washed using formulations used according to the invention exhibit very good filming properties.

The present invention further provides the use of copolymer (a1) obtainable by copolymerization of (a1.1) at least one N-vinylamide, (a1.2) vinyl acetate, (a1.3) at least one polyether, (a1.4) optionally at least one further comonomer, in formulations for machine dishwashing.

In one preferred variant, wherein copolymer (a1) is obtainable by copolymerization of in total in the range from 30 to 80% by weight of N-vinylamide (a1.1), in total in the range from 10 to 50% by weight of vinyl acetate (a1.2), in total in the range from 10 to 50% by weight of a polyether (a1.3), in total in the range from zero to 10% by weight of comonomer(s) (a1.4), in each case based on the mass of the total copolymer (a1).

Further properties of copolymer (a1) are described above.

The present invention further provides a process for producing preparations used according to the invention wherein at least one copolymer (a1) and at least one alkoxylate (a2) are mixed together.

In a preferred variant, the procedure involves melting at least one copolymer (a1) or at least one alkoxylate (a2), mixing it with copolymer (a1) or alkoxylate (a2) and then leaving it to cool.

In another preferred variant, the procedure involves mixing together at least one copolymer (a1) and at least one alkoxylate (a2), each in the molten state, and then leaving them to cool.

In one embodiment, copolymer (a1) and alkoxylate (a2) are mixed together, for example without dilution or in the presence of water, and then the water is optionally removed. Water can be removed for example by evaporation.

In a preferred embodiment of the present invention, copolymer (a1) is melted, for example in a stirred vessel, in a heatable tube or an extruder, and is then mixed with alkoxylate (a2) in solid or molten form. It can then be left to cool. In another embodiment of the present invention, alkoxylate (a2) is melted, for example in a stirred vessel, in a heatable tube or an extruder, and is then mixed with copolymer (a1) in solid or molten form. It can then be left to cool.

In a preferred embodiment of the present invention, copolymer (a1) and alkoxylate (a2), each in solid form, are mixed, then the resulting mixture is melted, for example in a stirred vessel, in a heatable tube or an extruder, and is then left to cool.

In another preferred embodiment of the present invention, copolymer (a1) can be admixed, in molten form, with solid alkoxylate (a2), whereupon alkoxylate (a2) melts. During this or subsequently, mixing is carried out, and the mixture is then left to cool.

In another preferred embodiment of the present invention, copolymer (a1) and alkoxylate (a2) are melted separately, the two melts are mixed and then left to cool.

Thus, it is for example possible to further process melt-liquid copolymer (a1), as is produced after the purification operations following its preparation, in a further step. For example, melt-liquid copolymer (a1) can be incorporated into a suitable mixing element and mixed with at least one alkoxylate (a2). Suitable mixing elements are, for example, a second extruder, kneader, dynamic and static mixers, and combinations thereof.

A suitable embodiment is the melting of copolymers (a1) and mixing with alkoxylate (a2). Here, the procedure may involve metering in the copolymer (a1) and alkoxylate (a2) individually or as a mixture into one or more inlet openings of an extruder and melting these with mixing and then cooling again and granulating. Or, only the copolymer (a1) is melted and alkoxylate (a2) is metered in at one or more points via a side dosage (side conveyor belt) into the liquid melt of copolymer (a1). In this embodiment, the extruder screw should be provided with suitable mixing elements. Suitable mixing elements can be, for example, conveying and nonconveying kneading blocks, toothed mixing elements, elements with perforated bars, turbomixing elements, knurled mixing elements, toothed blocks etc.

According to one embodiment, the dry copolymer (a1) is obtained in the presence of alkoxylate (a2). For this, the alkoxylate (a2) can be added to a solution or dispersion of the copolymer (a1) or to the molten copolymer (a1) and the resulting mixture can be passed to an extruder, or alkoxylate (a2) is introduced into the extruder separately. For example, the nonionic surfactant (a2) can be introduced as initial charge into the extruder cold in the form of a solid or liquid, and the polymer solution can be pumped in, and both degassed together, or the polymer solution can be introduced as initial charge, i.e. is pumped into the heated extruder and firstly a certain fraction of the solvent (for example 50-95%) is evaporated, and then, in a later stage, the nonionic surfactant (a2) is added as a solid or as a suspension (slurry) and solvents are evaporated together.

After cooling the mixture of copolymer (a1) and alkoxylate (a2), it can be left to cool and optionally comminuted. Of suitability for the comminution are in principle all customary techniques known for this purpose, such as hot or cold beating. Being left to cool and comminution can be carried out in any desired order. Thus, for example, it is possible to beat an extrudate of copolymer (a1) and alkoxylate (a2) with rotating knives or with a jet of air and then to cool it with air or under protective gas. In another variant, it is possible to lay an extrudate of copolymer (a1) and alkoxylate (a2) as melt strand on a chilled belt (stainless steel, Teflon, chain belt) and, following solidification, to granulate it or to grind it.

Other comminution methods such as e.g. spray-solidification are also possible.

Compounds of the general formula (I) can be obtained by alkoxylation of the corresponding $C_8$-$C_{24}$-alkohols with alkylene oxides. Here, the alkoxylation can be followed by an etherification, e.g. with a suitable alcohol or with another alkylating agent, in particular with dimethyl sulfate, or an esterification with a carboxylic acid.

Preferably, $R^2$ is hydrogen.

The alkoxylation can be carried out for example using alkaline catalysts, such as alkali metal hydroxides or alkali metal alcoholates, or with acidic catalysts, for example $BF_3.H_3PO_4$, $BF_3.2\ (C_2H_5)_2O$, $BF_3$, $SbCl_5$, $SnCl_4.2\ H_2O$ or hydrotalcite, or with double metal cyanide catalysts.

Processes for the preparation of copolymer (a1) are known per se, see, for example, WO 2007/051743. The preparation takes place preferably by means of radically initiated polymerization, preferably in solution, in nonaqueous organic solvents or in mixtures of water and nonaqueous organic solvents. Suitable nonaqueous organic solvents are, for example, alcohols, such as methanol, ethanol, n-propanol and isopropanol, and also glycols, such as ethylene glycol and glycerol. Also of suitability as solvents are esters, such as, for example, ethyl acetate, n-propyl acetate, isopropyl acetate, isobutyl acetate or butyl acetate, with ethyl acetate being preferred. To carry out the free-radical copolymerization, preference is given to introducing polyether (a1.3) as initial charge and adding N-vinylamide (a1.1), vinyl acetate (a1.2) and optionally further comonomer (a1.4), together or separately, simultaneously or successively.

The free-radical copolymerization is preferably carried out at temperatures of 60 to 100° C. A suitable pressure is, for example, atmospheric pressure, but it is also possible to select a higher or lower pressure.

The invention is illustrated in more detail by the working examples below.

WORKING EXAMPLES

I. Substances Used

I.1 Preparation of Copolymers (a1)

I.1.1 Preparation of Copolymer (a1-1)

Feed 1: 240 g of vinyl acetate (a1.2)

Feed 2: 456 g of vinylcaprolactam (a1.1-1), dissolved in 240 g of ethyl acetate

Feed 3: 10.44 g of tert-butyl perpivalate (75% by weight in aliphatics mixture), diluted with 67.90 g of ethyl acetate 104.0 g of polyethylene glycol ($M_w$: 6000 g/mol) (a1.3-1), dissolved in 25 g of ethyl acetate, are introduced as initial charge in a stirred apparatus and heated to 77° C. under an $N_2$ atmosphere. As soon as the internal temperature of 77° C. had been reached, 1 g of feed 3 was added and the mixture was polymerized for 15 min. The metered addition of feed 1, feed 2 and feed 3 was then started simultaneously. Feed 1 and feed 2 were metered in over the course of 5 hours, and feed 3 was metered in over the course of 2 hours. After all of the feeds had been metered in, the reaction mixture was stirred for a further 3 hours at 77° C. The reaction mixture was then diluted with 500 ml of water. Volatile constituents were then removed by steam distillation. The aqueous solution of copolymer (a1-1) obtainable in this way was freeze-dried. Copolymer (a1-1) were obtained after grinding as a very readily flowable powder. $M_w$: 44 000 g/mol I.1.2 Preparation of Copolymer (a1-2)

Feed 1: 500 g of vinylcaprolactam (a1.1-1) and 180 g vinyl acetate (a1.2), dissolved in 100 g of ethyl acetate Feed 2: 10.50 g of tert-butyl perethylhexanoate (98% by weight), diluted with 94.50 g of ethyl acetate 100.0 g of polyethylene glycol ($M_w$: 6000 g/mol) (a1.3-1) and 20 g of vinyl acetate (a1.2), dissolved in 165 g of ethyl acetate, were introduced as initial charge in a stirred apparatus and heated to 77° C. under an $N_2$ atmosphere. As soon as the internal temperature of 77° C. had been reached, 10.5 g of feed 2 were added and the mixture was partially polymerized for 15 min. The metered addition of feed 1 and feed 23 was then started simultaneously. Feed 1 was metered in over the course of 5 hours, and feed 2 was metered in over the course of 2 hours. After all of the feeds had been metered in, the reaction mixture was stirred for a further 3 hours at 77° C. The reaction mixture was then diluted with 500 ml of water. Volatile constituents were then removed by steam distillation. The aqueous solution of copolymer (a1-1) obtainable in this way was freeze-dried. Copolymer (a1-2) were obtained after grinding as a very readily flowable powder.

I.1.3 Preparation of Further Copolymers (a1-3) to (a1-5)

The procedure was as described in example 1.1.2, but choosing different compositions of feed 1 and feed 2 in each case.

This gave the following copolymers according to Table 1.

TABLE 1

Composition of copolymers (a1-1) to (a1-5)

| Copolymer | Composition in % by weight (a1.3-1) | (a1.1-1) | (a1.2) | K value (1% by weight in ethanol) |
|---|---|---|---|---|
| (a1-1) | 13 | 57 | 30 | 19.8 |
| (a1-2) | 12.5 | 62.5 | 25 | 18.5 |
| (a1-3) | 12.5 | 60 | 27.5 | 40.4 |
| (a1-4) | 14 | 51 | 35 | 25.2 |
| (a1-5) | 14 | 53.5 | 32.5 | 22.4 |

The alkoxylate (a2-1) used was: $n\text{-}C_{18}H_{37}—(OCH_2CH_2)_9OH$

II. Preparation of Formulations Used According to the Invention and Also of Comparison Formulations II.1 Preparation of Basis Mixtures The polycarboxylate (c-1) used was: random copolymer of acrylic acid/AMPS (2-acrylamido-2-methylpropanesulfonic acid), weight ratio 7:3, partially neutralized with NaOH, Mw: 20 000 g/mol, K value: 40, pH 5 (1% in distilled water).

To produce basis mixtures, in each case the substances in question as in Table 2 were mixed together dry in a kitchen appliance and divided with the help of a sample divider.

TABLE 2

Composition of basis mixtures

| | BF-P-free | BF-P-containing |
|---|---|---|
| Protease | 1 | 1 |
| Amylase | 0.2 | 0.2 |
| Polycarboxylate (c-1) | 10 | 6.5 |
| Sodium percarbonate | 10.5 | 14 |
| Tetraacetylethylenediamine | 4 | 4 |
| Sodium tripolyphosphate | — | 50 |
| $Na_2Si_2O_5$ | 2 | 2 |
| $Na_2CO_3$ | 18.8 | 18.8 |
| Sodium citrate dihydrate | 33 | — |
| Methylglycinediacetic acid, trisodium salt | 15 | — |
| HEDP | 0.5 | 0.5 |

HEDP: Disodium salt of hydroxyethane-(1,1-diphosphonic acid)
All quantitative data in g.

II.2 Preparation of Preparations Used According to the Invention and of Comparison Preparations Preparation of preparation according to the invention EZ-1

10 g of alkoxylate (a2-1) were melted and mixed with 5 g of solid copolymer (a1-1). This produced firstly an inhomogeneous mixture in the form of a cloudy solution. After cooling to room temperature and re-melting, a homogeneous mixture was obtained in the form of a clear solution. This was left to cool to room temperature, giving preparation EZ-1. EZ-1 was solid at room temperature.

II.3 Preparation of Phosphate-Free Formulation Used According to the Invention EF-1

19.95 g of basis mixture BP-P-free was introduced as initial charge. EZ-1 was then melted and 1.6 g of EZ-1, comprising 1.05 g of (a2-1) and 0.55 g of (a1-1) were added to BP-P-free. The formulation EF-1 obtainable in this way was left to solidify.

11.4 Preparation of Phosphate-Containing Formulations Used According to the Invention and Comparison Formulations II.4.1 Preparation of Formulation EF-1P Used According to the Invention 20.4 g of basis mixture BP-P-containing were introduced as initial charge. 0.9 g of EZ-1 was then melted and added dropwise to BP-P-containing. The formulation EF-1P obtainable in this way was left to solidify.

II.4.2 Preparation of Comparison Formulation V-F-2P 20.4 g of basis mixture BP-P-containing were introduced as initial charge. 0.6 g of alkoxylate (a2-1) were then melted and added dropwise to BP-P-containing. The comparison formulation V-F-2P obtainable in this way was left to solidify.

III. Testing of Formulations Used According to the Invention and Comparison Formulations For the tests for the machine dishwashing, the following experimental conditions were chosen:

Dishwasher: Miele G 1222 SCL

Program: 50° C. with R-time 2 (8 min) (without prerinse)

Ware: 3 knives (WMF Tafelmesser Berlin, Monoblock)

3 Amsterdam 0.21 drinking glasses

3 "OCEAN BLUE" BREAKFAST PLATES (made of melamine resin)

3 porcelain plates RIMMED PLATES FLAT 19 CM

Arrangement: Knives in the cutlery tray, glasses in the top basket, plates in the lower basket Dishwashing detergent: 21 g Addition of soiling: 100 g of clear-rinse soiling (comprises egg, starch and grease) were dosed in a frozen state Clear-rinse temperature: 65° C.

Water hardness: 21° German hardness (Ca/Mg):$HCO_3$ (3:1):1.35

Wash cycles: 6; in each case 1 h break in between (10 min with opened dishwasher door, 50 min with closed dishwasher door)

Evaluation: Visually after 6 wash cycles in a darkened chamber under light behind a perforated plate The ware was assessed after 6 wash cycles using a grading scale from 10 (very good) to 1 (very poor). Grades from 1-10 were awarded for spotting (very many, intensive spots=1 ranging to no spots=10) and for filming the grades 1-10 were awarded (1=very significant deposit, 10=no deposit).

IV.1 Results with Phosphate-Free Formulations

The test results are summarized in Table 3 (see following page).

IV.2 Results with Phosphate-Containing Formulations

The test results are summarized in Table 4 (see following page).

TABLE 3

Dishwasher tests with phosphate-free formulation EF-1

| | Spotting | | | | Filming | | | |
|---|---|---|---|---|---|---|---|---|
| Formulation | Knives | Glasses | Melamine plates | Porcelain plates | Knives | Glasses | Melamine plates | Porcelain plates |
| EF-1 | 10 | 10 | 8 | 7 | 5 | 6 | 6 | 6 |

TABLE 4

Dishwasher tests with phosphate-containing formulations

| | Spotting | | | | Filming | | | |
|---|---|---|---|---|---|---|---|---|
| Formulation | Knives | Glasses | Melamine plates | Porcelain plates | Knives | Glasses | Melamine plates | Porcelain plates |
| EF-1P | 7 | 7 | 9 | 8 | 5 | 7 | 8 | 7 |
| V-F-2P | 7 | 2 | 2 | 3 | 6 | 7 | 8 | 8 |

The invention claimed is:

1. A method of washing dishes in a machine dishwasher, the method comprising providing to the machine dishwasher a composition comprising (a1) a copolymer obtainable by copolymerization of (a1.1) a N-vinylamide, (a1.2) vinyl acetate, (a1.3) a polyether, (a1.4) optionally a further comonomer, (a2) an ethoxylate of a linear $C_{16}$-$C_{18}$-alkanol having on average 8.5 to 9.5 mol of ethylene oxide per mole of linear $C_{16}$-$C_{18}$-alkanol; or an alkoxylate comprising at least 80% by weight of at least one ethoxylate of a linear $C_{16}$-$C_{18}$-alcohol of formula (I) where m is 8, 9 or 10, $$R^1—(OCH_2CHR^2)_mR^3 \quad (I)$$

where:

$R^1$ is a $C_{16}$-$C_{18}$ linear alkyl, $R^2$ is $C_1$-$C_{10}$-alkyl, in each case identical or different, linear or branched, or hydrogen, and $R^3$ is $C_1$-$C_4$-alkyl, linear or branched.

2. The method according to claim 1, wherein the composition comprises from 1 to 50% by weight of the copolymer (a1) and 50 to 99% by weight of (a2).

3. The method according to claim 1, wherein the copolymer (a1) is obtainable by copolymerization of from 30 to 80% by weight of N-vinylamide (a1.1), from 10 to 50% by weight of vinyl acetate (a1.2), from 10 to 50% by weight of polyether (a1.3), from zero to 10% by weight of comonomer(s) (a1.4), in each case based on the mass of the total copolymer (a1).

4. The method according to claim 1, wherein copolymer (a1) is a graft copolymer.

5. The method according to claim 1, wherein the N-vinylamide (a1.1) is a N-vinyllactam.

6. The method according to claim 1, wherein the N-vinylamide (a1.1) is N-vinylpyrrolidone or N-vinylcaprolactam.

7. The method according to claim 1, wherein the polyether (a1.3) is a polyethylene glycol having an average molecular weight $M_w$ of from 1000 to 100 000 g/mol.

8. The method according to claim 1, wherein (a.2) is an ethoxylate of a linear $C_{16}$-$C_{18}$-alkanol having on average 8.5 to 9.5 mol of ethylene oxide per mole of linear $C_{16}$-$C_{18}$-alkanol.

9. The method according to claim 1, wherein (a2) comprises at least 80% by weight of at least one ethoxylate of a linear $C_{16}$-$C_{18}$-alcohol of the formula (I) where m is 8, 9 or 10.

10. The method according to claim 1, wherein the copolymer (a1) and the alkoxylate (a2) are present as a solid solution.

* * * * *